United States Patent [19]

Beckman et al.

[11] 4,432,699

[45] Feb. 21, 1984

[54] PERISTALTIC PIEZOELECTRIC PUMP WITH INTERNAL LOAD SENSOR

[75] Inventors: John B. Beckman, Cedartown; Martin J. Blickstein, Austell, both of Ga.

[73] Assignee: The Abet Group, Rome, Ga.

[21] Appl. No.: 451,231

[22] Filed: Jan. 3, 1983

Related U.S. Application Data

[63] Continuation-in-part of Ser. No. 374,890, May 4, 1982.

[51] Int. Cl.[3] ..... F04B 17/04; F04B 43/04; F04B 43/12

[52] U.S. Cl. ..... 417/63; 417/322; 417/474

[58] Field of Search ..... 417/63, 322, 412, 474

[56] References Cited

U.S. PATENT DOCUMENTS

| | | |
|---|---|---|
| 3,107,630 | 10/1963 | Johnson et al. . |
| 3,150,592 | 9/1964 | Stec . |
| 3,215,078 | 11/1965 | Stec . |
| 3,270,672 | 9/1966 | Haines et al. . |
| 3,361,067 | 1/1968 | Webb . |
| 3,465,732 | 9/1969 | Kattchee . |
| 3,753,426 | 8/1973 | Lilley . |
| 3,768,931 | 10/1973 | Willis, Jr. . |
| 3,840,758 | 10/1974 | Zoltan . |
| 3,963,380 | 6/1976 | Thomas, Jr. et al. . |
| 4,231,287 | 11/1980 | Smiley . |

FOREIGN PATENT DOCUMENTS

| | | | |
|---|---|---|---|
| 3007001 | 9/1981 | Fed. Rep. of Germany | 417/322 |
| 53-27103 | 3/1978 | Japan | 417/322 |

*Primary Examiner*—Richard E. Gluck

*Attorney, Agent, or Firm*—Jerry W. Mills; Gregory Howison; Jerry R. Selinger

[57] ABSTRACT

An apparatus for pumping a fluid by means of a piezoelectric pump is provided. All moving parts, including the valves and core, are piezoelectrically motivated. The preferred embodiment includes a piezoelectric ceramic tube having conductive bands adhered to the outer surface. The conductive bands and an inner surface electrode define tube regions which serve as valve and reservoir pump regions. A sensing circuit senses the voltage on the outer electrodes of the innermost of the piezoelectric regions to detect the presence of faulty pumping operation. The sensing circuit utilizes the piezoelectric effect that results from internal loading of the core.

18 Claims, 14 Drawing Figures

PERISTALTIC PIEZOELECTRIC PUMP WITH INTERNAL LOAD SENSOR

CROSS REFERENCE TO RELATED APPLICATIONS

This is a continuation-in-part of present application Ser. No. 374,890 filed May 4, 1982.

TECHNICAL FIELD

This invention relates to pumping fluids by means of a piezoelectric tube, and more particularly to piezoelectric pumping where all moving parts are piezoelectrically motivated.

BACKGROUND ART

Considerable effort has been expended in recent years to develop high-reliability, low flow-rate, miniature pumps. Piezoelectric technology has played a significant part in this effort. The development in this area has lead to several pump designs where part of the pump assembly utilized the piezoelectric effect, while the balance of the design retains conventional approaches. For example, in U.S. Pat. No. 3,215,078 to Stec, a piezoelectric tube is used for an impellor, but not for valving. U.S. Pat. No. 3,963,380 to Thomas use piezoelectric impellors and magnetic valves. U.S. Pat. No. 3,107,630 to Johnson uses a piezoelectric impeller with spring-loaded valves. U.S. Pat. No. 3,150,592 to Stec comes closest to an all-piezoelectric design, but still requires mechanical check valves.

Hybrid piezoelectric-mechanical assemblies, such as those in the above-referenced prior art, suffer a number of significant limitations. As a primary consideration, the mechanical parts of these prior art assemblies add mass and friction to the design, thereby increasing both energy requirements and operational wear, as well as inversely reducing reliability. An additional drawback of such hybrid assemblies is the increased time factors associated with mass and friction. Increased time factors reduce efficiency as well as limit the availability of miniature control devices, such as integrated circuit microprocessors. Another drawback of hybrid pumps is the noise commonly associated with any mechanical device. Attempts to limit such noise usually contribute to inefficiency and increase the size of the overall device. Further, hybrid assemblies must have sufficient size to accommodate the mechanical components, and this factor contributes to the difficulty in miniaturizing such pumps.

Reliability of pumps, an ever increasing requirement, is normally accomplished by placing external sensors about the pump to determine if fluid flow has stopped or been substantially diminished. These external sensors are bulky and inconvenient to use. In addition, they are separate from the pump itself, thus requiring a need for moving the sensors every time the pump is moved.

Accordingly, a need has arisen for a pump wherein all moving parts are piezoelectrically motivated and, in addition, a pump providing the capability for readily monitoring the pumping operation.

SUMMARY OF THE INVENTION

The present invention disclosed and claimed herein comprises a pump having a plurality of piezoelectric tube regions, each of the regions having an outer surface and an inner surface defining a cavity. An electrode is associated with each of the outer surfaces and inner surfaces for applying electrical signals to the surfaces. Each of the piezoelectric tube regions is activated by selectively phasing electrical signals such that the regions expand and contract to pump fluid through the cavity in a peristaltic motion. A sensing circuit is provided for sensing the piezoelectric effect of the innermost of the tube regions as a function of the internal forces within the cavity.

In another embodiment of the present invention, three piezoelectric bands are disposed about a resilient inner core having a passageway therethrough. An inner electrode is disposed between the piezoelectric bands and the core with outer electrodes disposed around the outer circumference of each of the piezoelectric bands. The innermost of the piezoelectric bands is operable to expand simultaneous with the first of the bands but with a delayed contraction. The third band is 180° out of phase with the first and second bands. A sensing circuit detects the decay time of the voltage on the outer electrode of the innermost of the piezoelectric bands when the innermost piezoelectric band is undergoing contraction. Internal forces that affect the piezoelectric operation of the piezoelectric band provide an indication of pump malfunction.

In yet another embodiment of the present invention, a computer is provided to control the selective phasing of the electrical signals applied to the outer electrodes as a function of the sensing circuit. The computer calculates the total volume for each stroke of the pump and the total volume output by the pump over a given period of time. By monitoring the sensing circuit, the computer detects the presence of a material within the pump that has a different compressability than the fluid flowing through the pump by comparing the operation of the pump with pre-stored data. The computer also analyzes the sensing circuit to detect malfunctions of the first and second piezoelectric bands and is operable to sound an alarm. Other aspects of the present invention will become apparent hereinafter.

BRIEF DESCRIPTION OF THE DRAWINGS

A more complete understanding of the invention and its advantages will be apparent from the following Detailed Description taken in conjunction with the accompanying Drawings in which.

DETAILED DESCRIPTION

Figure 1:
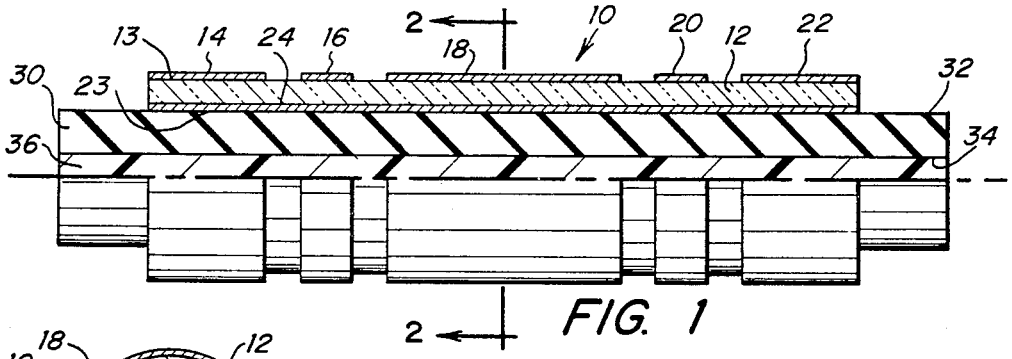
FIG. 1 is a partially broken away side view of a piezoelectric pump constructed in accordance with the invention.
Figure 2:
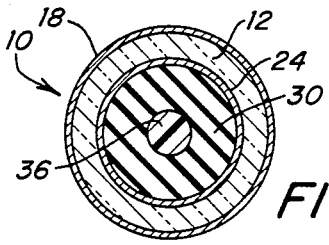
FIG. 2 is a sectional view of FIG. 1 taken along lines 2—2 of FIG. 1.

Referring initially to FIGS. 1 and 2, pump 10 includes piezoelectric ceramic tube 12 with conductive metal bands 14, 16, 18, 20 and 22 fired or otherwise adhered to outer surface 13 of tube 12. Bands 14, 16, 18, 20 and 22 are electrodes adapted to apply electric potential to outer surface 13. Electrode 24, extends across the entire inner surface 23 of tube 12.

Pump 10 includes core 30, which in the preferred embodiment is a resilient body constructed of an elastomeric substance such as silastic rubber. Core 30 has an outer surface 32 and an inner surface 34. Outer surface 32 is attached to electrode 24 for co-movement with tube 12. Core pin 36 is disposed within inner surface 34 of core 30. In the preferred embodiment, core pin 36 is manufactured of a solid incompressible material.

Figure 3:
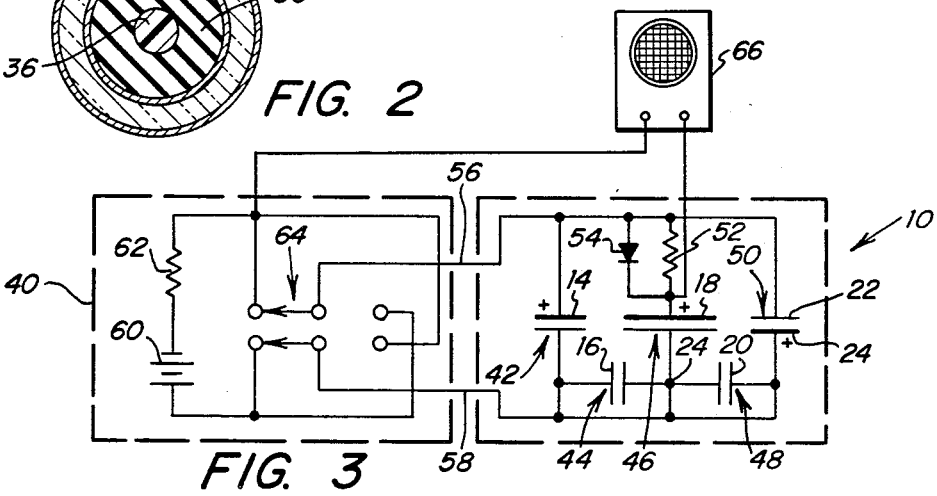
FIG. 3 is a schematic representation of the pump of FIG. 1 and of control circuitry adapted for use with the invention.

Referring now to FIG. 3, pump 10 and power supply 40 are represented in symbolic schematic form. Piezoelectric ceramics, such as the material of which tube 12 is constructed, are high dielectric materials, and therefore produce relatively high capacity between inner electrode 24 and each of conductive bands 14, 16, 18, 20 and 22, as well as between adjacent conductive bands 14, 16, 18, 20 and 22. Accordingly, each of the conductive bands in conjunction with the inner electrode defines a tube "region" which may be illustrated as a capacitor. Thus, conductive band 14 and inner electrode 24 form tube region 42, conductive band 16 and inner electrode 24 form tube region 44, conductive band 18 and inner electrode 24 form tube region 46, conductive band 20 and inner electrode 24 form tube region 48, and conductive band 22 and conductive band 24 form tube region 50. Tube regions 42 and 46 are poled oppositely to tube region 50, that is, positive conductive band 14 and positive conductive band 18, through resistor 52 and diode 54, are connected to power supply 40 through line 56, while conductive positive band 22 is connected to power supply 40 through line 58.

Power supply 40 is composed of DC power source 60, having system resistance 62, and switch 64. Switch 64 is symbolically illustrated as a DPDT switch. It will be understood that the invention is not limited to such an arrangement, but could include a battery and a variable voltage multiplier or an electronic integrated circuit, whose switching rate might be variable, or some other dual polarity switch circuit. Power supply 40 switches the output of battery 60, through system resistance 62, to lines 56 and 58 connected to the center portions of switch 64. In the preferred embodiment, switch 64 is alternated from one pole to the other at a regular cycle rate to produce a square wave output having a known frequency.

In operation, tube region 42 functions as an "In" valve, tube region 46 functions as a "Reservoir," and tube region 50 functions as an "Out" valve. Tube regions 44 and 48 perform a shielding function which will be described in more detail below. The piezoelectric ceramic material of which tube 12 is constructed has the characteristic of expanding in the direction in which it is "poled." As described above, "In" valve tube region 42 and "Reservoir" tube region 46 are poled oppositely to "Out" Valve tube region 50. This means that "Out" valve region 50 contracts under the same circumstance. Conversely, "In" valve region 42 and "Reservoir" region 46 contract when a positive voltage is applied to line 58, while "Out" valve region 50 expands under this condition.

As shown in FIG. 3, "Reservoir" region 46 is connected to power supply 40 through a parallel diode-resistor circuit composed of resistor 52 and diode 54. Diode 54 acts as a selective switch. When line 56 is positive, diode 54 short circuits resistor 52 reducing the charging time constant of the "Reservoir" region 46 capacitance. In the reverse circumstance, i.e., line 58 being positive, the diode is reverse-biased, permitting resistor 52 to become part of the "Reservoir" region 46 discharge time constant.

An oscilloscope 66 has the sensing lead thereof connected to the conductive band 18 for sensing the voltage thereon and the ground lead thereof connected to the negative side of the battery 60. The oscilloscope 66 displays the waveform that appears on the band 18 for determining the operating conditions of the pump, as will be described hereinbelow.

Figure 5:
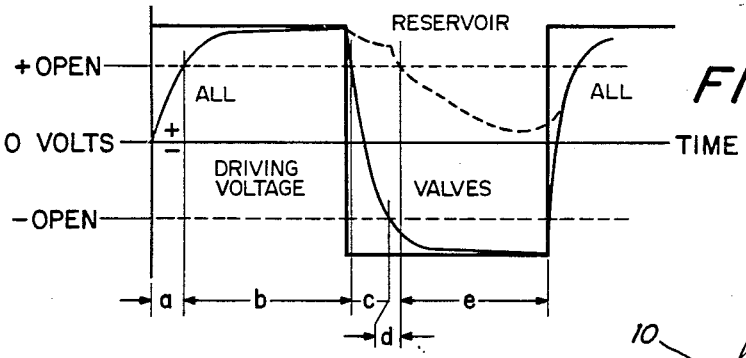
FIG. 5 is a graph illustrating the operation of the present invention.
Figure 6:
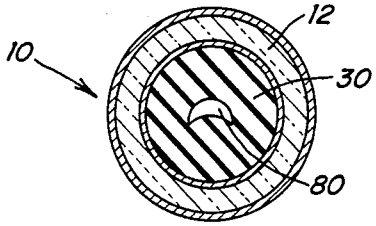
FIG. 6 is a sectional view of a first alternate embodiment of the present invention.
Figure 4A:
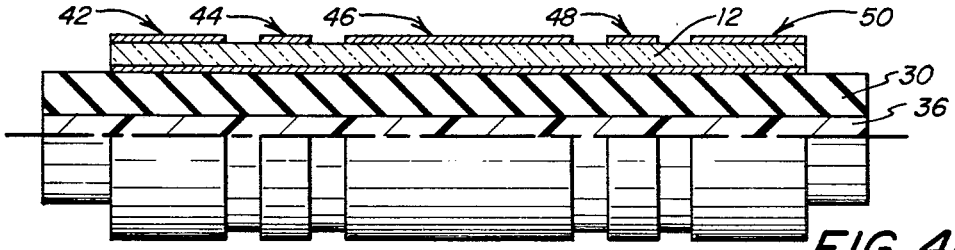
FIGS. 4*a–e* illustrate one cycle of the pump of FIG. 1.
Figure 4B:
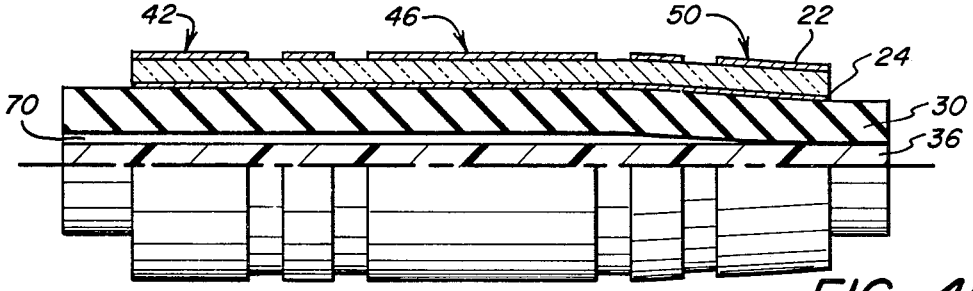
Figure 4C:
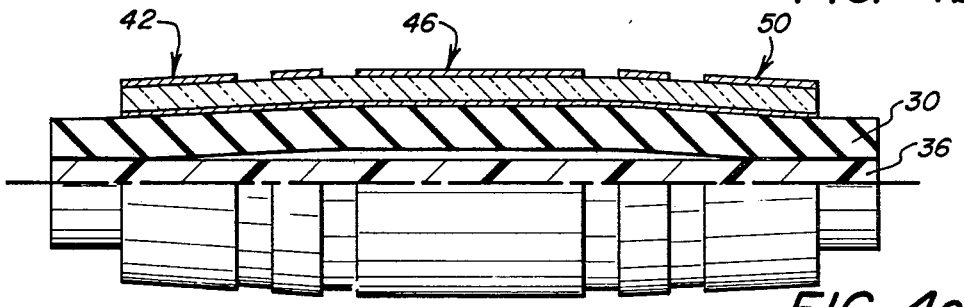
Figure 4D:
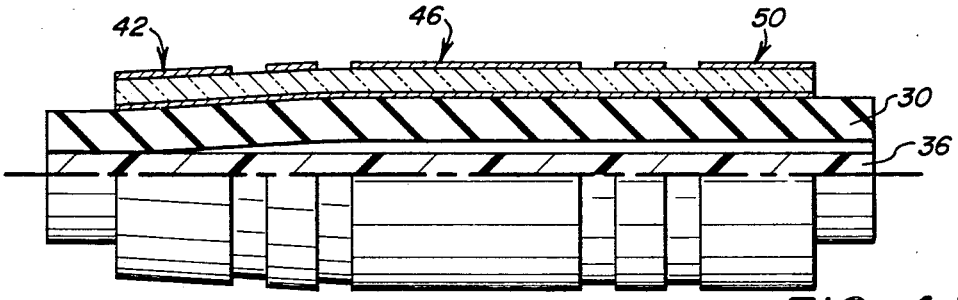
Figure 4E:
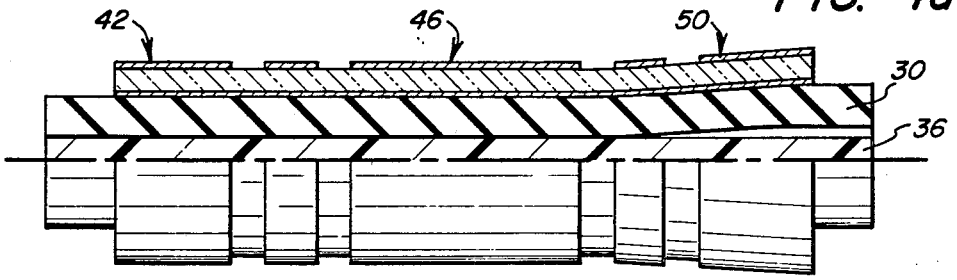

Referring now to FIGS. 4*a*–4*e* and FIG. 5, the operation of pump 10 through one cycle may be more clearly understood. The letters "a," "b," "c," "d" and "e" on FIG. 5 correspond to the reference letters of FIGS. 4*a*–4*e*. Thus, FIG. 4*a* illustrates pump 10 in the time range referenced by letter "a" in FIG. 5, and so forth. In FIG. 5, the heavy line designates the driving voltage of power supply 40 while the lighter line represents the status of "In" and "Out" valves. The dashed line represents the status of the "Reservoir." FIG. 5 shows the electrical performance of "In" valve region 42, "Reservoir" region 46 and "Out" valve region 50.

Figure 7:
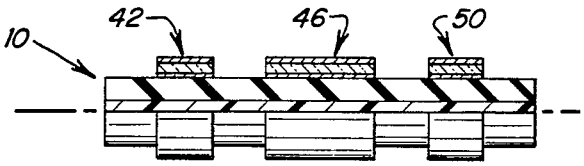
FIG. 7 is a side view of a second alternate embodiment of the present invention.

The guard regions may be eliminated by physically separating the valve and "Reservoir" regions as shown in FIG. 7. This configuration has an advantage in that the need for piezoelectric ceramic is reduced. Of course, the guard bands may also be eliminated in a single monolithic tube design if the regions are spaced a sufficient distance apart. In the preferred embodiment shown in FIG. 1, the provision of guard regions allows a reduction in axial length which will be desirable in many applications.

Figure 8:
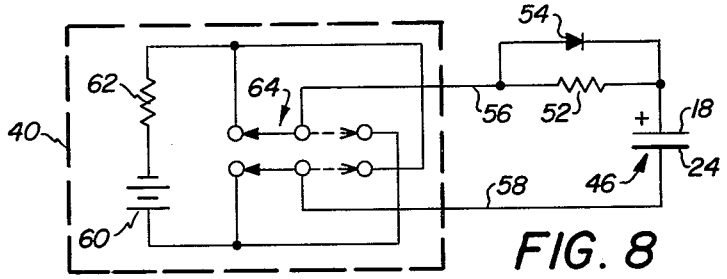
FIG. 8 is a basic schematic diagram of a sensing circuit for sensing the operation of the pump of the present invention.

Referring now to FIG. 8, there is shown a simplified equivalent schematic diagram similar to the schematic of FIG. 3 except that only the conduction band 18 and the conduction band 24 are illustrated for simplicity of discussion. The switch 64 is illustrated with the negative pole of the battery 60 connected to the anode of the diode 54 and the positive terminal of the battery 60 connected to the conduction band 24 which comprises the negative side of the capacitor formed thereby. In this configuration, the diode 54 is reverse biased thereby forcing any current flow through the resistor 52. This in effect forces the charge stored on the plate formed by the conduction band 18 to discharge through the resistor 52 with a time constant formed by the combination of the resistor 52 and the capacitor formed between the conduction bands 18 and 24. When the switch 64 is reversed, as shown by the dotted lines, the positive terminal of the battery 60 is connected to the anode of the diode 54 and the negative terminal of the battery 60 is connected to the conduction band 24 through the resistor 62. Since the diode 54 is now forward biased, current flows into the conduction band 18 for storage between the conduction band 18 and 24. When the switch 64 is operative to alternately switch from one position to another, the anode of the diode 54 is subjected to a positive and negative alternating voltage which, when positive, stores charge through the conduction band 18 and, when negative, discharges through the conduction band 18 and through the resistor 52.

The material between the conduction bands 18 and 24 is a piezoelectric crystal which expands or contracts depending upon the voltage impressed thereacross. However, the piezoelectric crystal also functions in a passive mode since it is operable to generate a voltage when an external force causes either expansion or contraction thereof. For example, when an external force is applied in the direction of the original poling force, the piezoelectric crystal produces a positive voltage across the electrodes, with the opposite polarity produced by reversing the force. In this sense, and an important aspect of the present invention, the piezoelectric crystal disposed between the conduction bands 18 and 24 is a sensor in that it detects the presence of a force and the direction of that force within the "Reservoir."

An external force applied to the piezoelectric crystal that is disposed between the conduction bands 18 and 24 is operable to increase the voltage across the terminals attached thereto when the external force is an expansive force. This results in a positive voltage added to the already decreasing voltage. For example, when the voltage changes from positive to negative, the charge stored within the piezoelectric crystal decays through the conduction band 18 and through the resistor 52. Under normal conditions, this decay time is reasonably uniform. However, if one of the input or output valves does not open or operate properly, the contractions of the piezoelectric crystal between the conduction bands 18 and 24 is somewhat impeded. This results in a more positive voltage occurring across the conduction bands 18 and 24. The result is that a slightly larger amount of charge is stored therebetween and a longer duration of time is required for the charge to decay through the resistor 52. By examining the decay time of the voltage waveform, it is possible to determine the operation of the pump, as will be described hereinafter.

Figure 9:
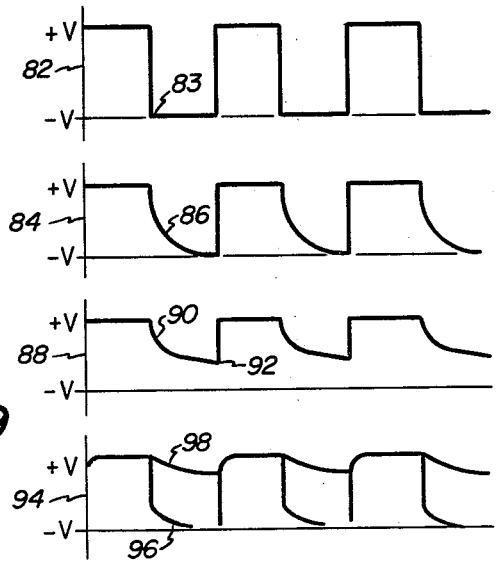
FIG. 9 illustrates the timing diagrams for the circuit of FIG. 8.

Referring now to FIG. 9, there is illustrated a series of timing waveforms depicting the operation of the piezoelectric material disposed between the conduction bands 18 and 24 for various conditions thereof. The waveform 82 depicts the operation of the switch 64 which alternates between +V and −V. The x coordinate is a time base coordinate depicting the periodicity of the waveform. A waveform 84 depicts the operation of the pump with a compressible fluid, such as air, disposed therein. The switch 64 is positive for a period of time and then it is switched to a negative voltage depicted by the point 83 on the waveform 82. During the period of time that the switch 64 connects the positive terminal of the battery 60 to the anode of the diode 54, the capacitor formed by the conduction bands 18 and 24 is charging which, due to the small internal resistance 62 of the battery, is a very short time.

When the switch 64 makes a transition from a positive to a negative voltage on the anode of the diode 54, the voltage on the conduction band 18 begins to decay through the resistor 52, as depicted by a curve 86 on the waveform 84. Air, since it is compressible, presents a very small opposing force within the "Reservoir." Since the waveform is periodic, after a duration of time the switch 64 is again switched to a positive voltage and the conduction band 18 is again raised to a positive voltage. Depending upon the value of the resistor 52 and the capacitor formed by the piezoelectric material between the conduction bands 18 and 24, the voltage on the conduction band 18 may decay to −V.

A waveform 88 depicts the operation of the pump under normal conditions with a compressible fluid disposed therein. In the normal operation of the pump, the "In" valve 42, the "Out" valve 50 and the "Reservoir" region 46 are expanded and contracted to provide a peristaltic motion, as described above. When the voltage is initially increased to a positive voltage, the "In" valve 42 and the "Reservoir" region 46 expand while the "Out" valve 50 contracts. This allows fluid to enter the "Reservoir" region 46. At the point in time represented by the point 83 on the waveform 82, the switch 64 changes polarity thereby making a transition from a positive voltage to a negative voltage on the valves 42 and 50 and the "Reservoir" region 46. The result is that the "In" valve 42 contracts thereby closing the input and the "Out" valve 50 expands to open the output valve. Due to the presence of the resistor 52, the "Reservoir" region 46 does not immediately contract as does the "In" valve 42. Since there is an incompressible fluid in the "Reservoir" region 46, contraction of the "Reservoir" region 46 is opposed by the incompressability of the fluid. This results in an increase in the voltage of the capacitor between the conduction bands 24 and 18 thereby increasing the amount of stored charge and increasing the decay time. This is illustrated by curve 90 which depicts an exponentially decaying voltage that is the function of the capacitance between the conduction bands 18 and 24 and the resistor 52 with the addition of the passive force of the incompressible liquid in the "Reservoir" region 46.

The curve 90 continues to decay until the fluid is entirely evacuated from the "Reservoir" region 46 or the voltage is again changed from a negative voltage to a positive voltage, as indicated by a point 92 on the waveform 88. At this transition point, the "In" valve 42 and the "Reservoir" region 46 are again expanded to allow efferent flow into the "Reservoir" region 46.

A waveform 94 illustrates the conditions wherein the "In" valve 42 and the "Out" valve 50 are alternatively defective. When the "In" valve 42 is defective, efferent flow into the "Reservoir" region 46 is inhibited. This results in a slight vacuum therein upon expansion of the piezoelectric material around the "Reservoir" region 46. Upon making a transition from a positive voltage to a negative voltage, the slight vacuum internal to the "Reservoir" region 46 acts as an "enhancing" force that enhances the contraction thereof. This is because the force internal to the "Reservoir" region 46 is a negative force rather than a positive force. This defective "In" valve 42 is represented by a curve 96. It can be seen that the curve 96 decays very rapidly as a result of the lack of fluid within the "Reservoir" region 46 in addition to the slight vacuum therein.

When the "Out" valve 50 is defective, fluid stored in the "Reservoir" region 46 is inhibited from exiting therefrom. Upon contraction of the "Reservoir" region 46, a strong opposing force results from the failure of the incompressible liquid to flow therefrom. This strong opposing force maintains a positive voltage on the conduction band 18. Although some charge decays through the conduction band 18 and through the resistor 52, additional charge is being stored between the conduction bands 18 and 24 as a result of the incompressible liquid within the "Reservoir" region 46. The defective "Out" valve 50 operation is illustrated by a curve 98 which depicts a very slow decay time.

By sampling the amount of decay that occurs between the time that the voltage makes a transition from a positive to a negative voltage and the time that the waveform makes a transition from a negative to a positive voltage, the operation of the "In" and "Out" valves 42 and 50 can be determined. This requires only that the voltage is sampled during this interval to determine if the voltage has decayed to the proper level to indicate that either the "In" or the "Out" valves 42 and 50 are operating properly. Improper operation results in either too short of a decay time or too long of a decay time which can easily be detected by external electronics.

Figure 10:
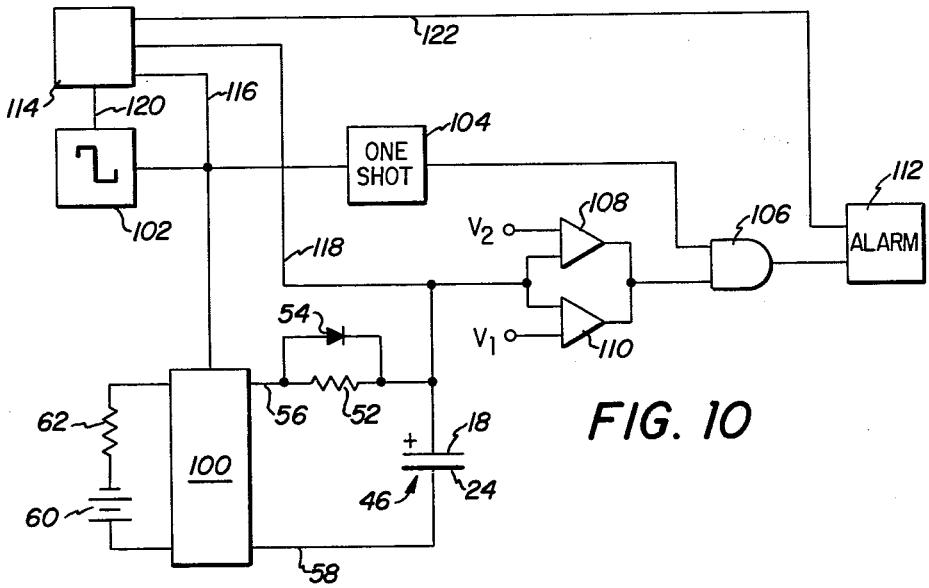
FIG. 10 is an exemplary embodiment of the sensing circuit.

Referring now to FIG. 10, there is shown an alternate embodiment of the present invention with an automatic sensing circuit that sounds an alarm upon detecting faulty operation of the pump. The switch 64 is replaced with a solid state switch or relay 100 that is operable to switch at the desired rate for the pump. The switch 100 is driven by an astable multivibrator 102 that can incorporate any general operational amplifier circuit. An example of this can be found in Linear Applications, National Semiconductor Corp., Vol. 1 (1973) Page AN31-6. The output of the multivibrator 102 is input to a one shot 104 that is of the type 74LS123 manufactured by Texas Instruments, Incorporated. The one shot 104 is adjusted to output a sample pulse at a selected point in time between the moment that the switch 100 alternates the voltage source from a positive to negative voltage and the moment that the voltage is returned to a positive voltage. The one shot 104 is operable to control one input of an AND gate 106.

A comparator 108 and a comparator 110 both have one input lead thereof connected to the conducting band 18 and the outputs thereof connected to the other input of the AND gate 106. The comparators 108 and 110 are of the type LM311 manufactured by National Semiconductor Corp. and are connected to provide a window comparator. The threshold input of the comparator 108 is connected to a voltage $V_1$ and the comparator 110 has its threshold input connected to a threshold voltage $V_2$.

By varying the threshold voltages $V_1$ and $V_2$, the comparators 108 and 110 are operable to only output a signal when the decay time of the voltage between the conducting bands 18 and 24 is either below one threshold or above another threshold. The one shot 104 is operable in conjunction with the comparators 108 and 110 to sample this voltage only at a specific time. At this specific time, the output of the AND gate 106 triggers an alarm 112. The thresholds $V_1$ and $V_2$ can be adjusted to provide for tolerances and loads experienced within the "Reservoir" region 46 in a normal operating environment.

By sampling the voltage on the conducting band 18 during relaxation of the "Reservoir" region 46, the pump parameters which can be indicated by a symbiotic pump-sensor relationship are:

(1) the total volume can be electronically calculated by the wave shape for each stroke;

(2) the total volume for a given period of time can be calculated electronically by multiplying the time by the number of pulses per second;

(3) the presence of a compressible gas such as air can determine an alarm situation by detecting excessively rapid decay time;

(4) problems such as valve malfunction can be detected and electronically analyzed by sensing decay time; and (5) pump rate can be electronically calculated by measuring the time between disconnecting and reconnecting the switch.

To provide further capability for the monitoring of the piezoelectric pump, there is provided an automatic monitoring system through use of a computer 114 that monitors the operation of the piezoelectric pump and also controls the operation of the piezoelectric pump. The computer 114 is connected to the output of the astable multivibrator 102 and to a sensing line 116 for sensing the frequency thereof. The computer 114 is connected to the astable multivibrator 102 through a control line 110 and is operable to both control and sense the astable multivibrator 102 and, through this control, control the operation of the switch 100. By sensing the rate of switching that is output by the astable multivibrator 102 and the relaxation rate from the capacitor formed between the conducting bands 18 and 24, the operation of the pump, as described above, can be monitored. The computer 114 can perform the functions 1–5 described above and automatically monitor the operation of the piezoelectric pump. The alarm 112 is connected by a control line 122 such that the computer 114 can override the operation of the alarm 112 and activate it. It should be understood that the computer 114 can be any microprocessor-based unit such as those utilizing the Z-80 microprocessor manufactured by Intel Corp. and the associated circuitry supplied therewith.

Although the preferred embodiment has been described in detail, it should be understood that various changes, substitutions and alterations can be made therein without departing from the spirit and scope of the invention as defined by the appended claims.

What we claim is:

1. A piezoelectric pump comprising:

a plurality of piezoelectric tube regions, each said region having an outer surface and an inner surface defining a cavity;

an electrode associated with each said outer surface and inner surface for applying electric signals to said surfaces;

means for selectively phasing said electrical signals such that said regions expand and contract in a peristaltic motion to pump fluid through said cavity; and means for sensing the piezoelectric effect that results from the internal load on the innermost of said piezoelectric tube regions.

2. The pump of claim 1 wherein each of said tube regions comprises:

a resilient inner cylindrical core with an axial passageway therethrough; and a piezoelectric cylinder having the inner surface proximate the outer surface of said resilient inner cylindrical core.

3. The pump of claim 1 wherein said electrode associated with each of said inner surfaces is disposed between said resilient inner cylindrical core and the inner surface of said piezoelectric cylinder and the said electrode associated with said outer surface of each of said tube regions is disposed adjacent to the outer surface of said piezoelectric surface.

4. The pump of claim 1 wherein each of said piezoelectric tube regions comprise:

a resilient inner cylindrical core with an axial passageway disposed therethrough;

a first piezoelectric cylinder having the inner surface proximate to the outer surface of said core;

a second piezoelectric cylinder having the inner surface proximate to the outer surface of said core; and a third piezoelectric cylinder having the inner surface disposed adjacent to the outer surface of said core;

said second piezoelectric cylinder disposed between said first and third piezoelectric cylinders.

5. The pump of claim 4 wherein said electrode associated with the inner surface of said regions comprises a single electrode disposed between said core and said first, second and third peizoelectric cylinders.

6. The pump of claim 5 wherein each of said first, second and third piezoelectric cylinders has an electrode disposed circumferentially about the outer surface and adjacent thereto.

7. The pump of claim 1 wherein said means for sensing comprises means for measuring the rate of decay of capacitive energy stored in at least one of said piezoelectric tube regions during relaxation of said tube region.

8. The pump of claim 1 further comprising a computer for controlling the operation of said means for phasing, said computer also receiving the output of said sensing means.

9. The pump of claim 8 wherein said computer calculates the total volume for each stroke of the pump.

10. The pump of claim 8 wherein said computer calculates the total volume output by the pump over a given period of time.

11. The pump of claim 8 wherein said computer detects the presence of a material within the pump that has a different compressability than the fluid flowing through the pump by comparing the operation of the pump with prestored data.

12. The pump of claim 8 wherein said computer calculates the pump rate.

13. A piezoelectric pump, comprising:

an inner cylindrical core of resilient material having a passageway therethrough;

an inner electrode disposed adjacent to the outer surface of said core;

a first piezoelectric band disposed about said core having the inner surface thereof adjacent said inner electrode;

a second piezoelectric band disposed about said core having the inner surface thereof adjacent said inner electrode;

a third piezoelectric band disposed about said core having the inner surface thereof adjacent said inner electrode;

an outer electrode associated with each of said first, second and third piezoelectric bands and disposed adjacent the outer surfaces thereof;

said second piezoelectric band disposed between said first and third piezoelectric bands;

means for selectively activating said first, second and third piezoelectric bands to contract and expand to provide a peristaltic pumping motion of the passageway through said resilient core; and means for sensing the piezoelectric effect of internal forces within the passageway of said core on said second piezoelectric band.

14. The pump of claim 13 wherein said first and second piezoelectric bands are poled opposite to said third piezoelectric band.

15. The pump of claim 14 wherein said means for selectively activating comprises:

a voltage source having positive and negative terminals;

a switch connected to the positive and negative terminals of said voltage source and having output terminals, said switch operable to alternate the voltage of said output terminals;

said outer electrode attached to said first and third piezoelectric bands attached to one terminal of said switch and said inner electrode attached to the remaining output terminal of said switch;

a diode disposed between said one output terminal of said switch and said outer electrode of said second piezoelectric band, said diode oriented to allow simultaneous expansion of said first and second piezoelectric bands;

a resistor disposed between said one output terminal of said switch and said outer electrode of said second piezoelectric band, said resistor providing a time constant when said diode is reversed biased; and means for alternately switching said switch.

16. The pump of claim 15 wherein said means for sensing comprises means for detecting the decay time of the voltage on said outer electrode of said second piezoelectric band across said resistor when said diode is reverse biased.

17. The pump of claim 15 wherein said means for detecting decay comprises:

means for sampling the voltage across said resistor at a specified interval of time between reverse bias of said diode and forward bias of said diode; and means for determining if the level of the voltage is within a pre-determined limit.

18. The pump of claim 17 wherein said means for determining comprises a window comparator having a first threshold and a second threshold.

* * * * *